US006571942B2

(12) United States Patent
Riemenschneider et al.

(10) Patent No.: US 6,571,942 B2
(45) Date of Patent: Jun. 3, 2003

(54) CONTAINER WITH INTEGRAL MATERIAL-TREATING CONTAINER AND METHOD OF FABRICATION THEREOF

(75) Inventors: Paul A. Riemenschneider, Williamsville, NY (US); James V. Renda, North Tonawanda, NY (US)

(73) Assignee: Multisorb Technologies, Inc., Buffalo, NY (US)

( * ) Notice: Subject to any disclaimer, the term of this patent is extended or adjusted under 35 U.S.C. 154(b) by 0 days.

(21) Appl. No.: 09/925,577

(22) Filed: Aug. 9, 2001

(65) Prior Publication Data

US 2003/0029739 A1 Feb. 13, 2003

(51) Int. Cl.[7] ..... B65D 81/26
(52) U.S. Cl. ..... 206/204; 206/540; 53/400
(58) Field of Search ..... 206/204, 528, 206/538, 540; 53/400–402, 410, 428, 431, 432, 435, 449

(56) References Cited

U.S. PATENT DOCUMENTS

| | | | | | |
|---|---|---|---|---|---|
| 1,388,429 | A | | 8/1921 | Heyl | |
| 2,196,021 | A | | 4/1940 | Merrill | |
| 2,317,882 | A | * | 4/1943 | Boesel | 206/204 |
| 2,425,250 | A | | 8/1947 | Lamb | |
| 2,515,189 | A | | 7/1950 | Brown et al. | |
| 3,135,566 | A | | 6/1964 | Frank | |
| 3,567,085 | A | | 3/1971 | Flores | |
| 3,820,309 | A | | 6/1974 | Cullen et al. | |
| 3,826,358 | A | | 7/1974 | Butler et al. | |
| 3,918,578 | A | * | 11/1975 | Cullen et al. | 206/204 |
| 4,201,296 | A | | 5/1980 | Hrabik | |
| 4,387,803 | A | | 6/1983 | Mercil | |
| 4,394,144 | A | * | 7/1983 | Aoki | 206/204 |
| 4,834,234 | A | * | 5/1989 | Sacherer et al. | 206/204 |
| 5,018,621 | A | | 5/1991 | O'Connell, Jr. | |
| 5,114,003 | A | | 5/1992 | Jackisch et al. | |
| 5,813,564 | A | * | 9/1998 | Luo | 206/204 |
| 5,934,494 | A | * | 8/1999 | Takahashi et al. | 206/204 |
| 6,274,209 | B1 | * | 8/2001 | Pagidas et al. | 206/204 |

* cited by examiner

*Primary Examiner*—Luan K. Bui
(74) *Attorney, Agent, or Firm*—Joseph P. Gastel

(57) ABSTRACT

A container including a body, a top portion and a bottom portion on the body, a first wall on the body, a material-treating container, a second wall on the material-treating container, a material-treating substance in the material-treating container, a permeable cover on the material-treating container, and the second wall being positioned coextensively within the first wall with the material-treating container in hermetic sealing relationship with the bottom portion of the first wall and with the permeable cover within the body.

23 Claims, 1 Drawing Sheet

CONTAINER WITH INTEGRAL MATERIAL-TREATING CONTAINER AND METHOD OF FABRICATION THEREOF

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to an improved container which includes an integral second container containing a material-treating substance and a method of fabrication thereof.

By way of background, certain materials, such as pills, diagnostic test strips and certain granular substances which are packed in containers require the presence of a material-treating substance to either adsorb moisture or absorb oxygen and/or absorb odors in order to preserve the integrity of those materials.

BRIEF SUMMARY OF THE INVENTION

It is one object of the present invention to provide a container having an integral material-treating second container with a material-treating substance therein which is associated with the body of the container in an unique manner.

Another object of the present invention is to provide a container having a second container of a material-treating substance which is assembled with the container after it has been filled so that the material-treating container need not be unduly exposed to the atmosphere prior to and during the filling.

A further object of the present invention is to provide an improved method of fabricating and filling a container which also requires a material-treating substance. Other objects and attendant advantages of the present invention will readily be perceived hereafter.

The present invention relates to a container comprising a body, a top portion and a bottom portion on said body, a first wall on said body, a material-treating container, a second wall on said material-treating container, a material-treating substance in said material-treating container, a permeable cover on said material-treating container, and said second wall being positioned coextensively with said first wall and with said material-treating container in hermetic sealing relationship within said first wall and with said permeable cover within said body.

The present invention also relates to a method of fabricating a container comprising the steps of providing a body having a first wall, providing a material-treating container with a material-treating substance therein and having a second wall and a permeable membrane thereon, and installing said material-treating container in hermetic sealing relationship in said body with said second wall in coextensive engagement with said first wall with said permeable membrane within said body.

The various aspects of the present invention will be more fully understood when the following portions of the specification are read in conjunction with the accompanying drawings wherein:

DETAILED DESCRIPTION OF THE INVENTION

Figure 1:
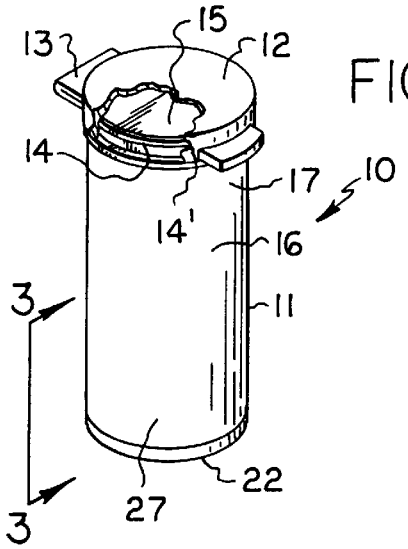
FIG. 1 is a partially broken away perspective view of the improved container of the present invention.
Figure 2:
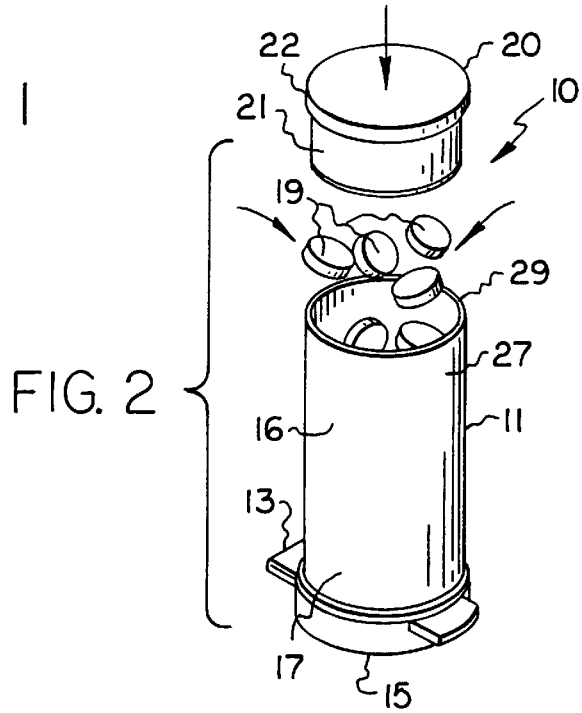
FIG. 2 is a perspective view of the manner in which the container is filled and subsequently assembled.
Figure 3:
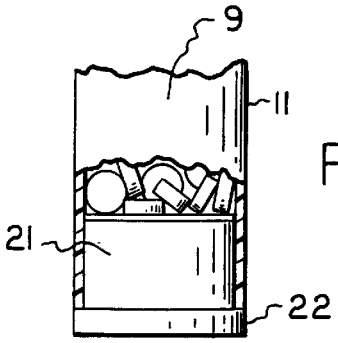
FIG. 3 is a fragmentary view, partially in cross section, taken substantially in the direction of arrows 3—3 of FIG. 1.

The improved container 10 of the present invention is in the form of a vial or bottle having a cylindrical body 11 having a wall 16 fabricated of a suitable plastic with barrier properties, in this instance polyethylene, and having a cover 12 secured thereto by a living hinge 13. The groove 14' in the cover 12 snaps into place about ridge 14 in the well known manner. Also, a safety seal 15 is secured to the upper edge of the top portion 17 of body 11. While the specific container 10 is shown in the form of a cylindrical vial, it will be appreciated that it can take any other form, shape or size consistent with the manner in which it is filled and/or assembled, as described in detail hereafter. The other forms, without limitation may be square, rectangular or oval.

The container 10 can be used for containing items such as pills 19, or other subject matter such as diagnostic test strips which must be protected from moisture or from oxygen. To this end a material-treating container 20, which is fabricated of polyethylene, is provided having a cylindrical wall 21 and a rim 22 which terminates at an annular shoulder 23. The material-treating container 20 is intended to contain a material-treating substance 24 which may be a desiccant, an oxygen absorber or odor absorber of any well known type. The adsorbent may be any suitable adsorbent and may include without limitation, silica gel, molecular sieve or activated carbon, and the oxygen absorber may be of any suitable type. However, the material-treating container can contain any type of material-treating substance for treating the contents of the container, and such substances may also be, without limitation, moisture providers, fragrances, and deodorizers. A permeable membrane 25 is sealed to the upper annular edge 27' of wall 21 so that there can be communication between the interior of the vial and the interior of the material-treating container. The permeable membrane 25 may be spun-bonded polyethylene known under the trademark TYVEK, or any other suitable permeable membrane including but not limited to a permeable cellulose material.

In use, subject matter such as pills 19 which have to be protected from moisture are placed into container 11 through the open bottom portion 27 thereof. At this point it will be understood that the container 11 already has had its safety seal 15 fabricated thereto. After the pills 19 have been filled into body 11, the material-treating container 20 is inserted into the bottom portion 27 of body 11 with a press-fit in the nature of an interference fit so that the material-treating container is tightly held within wall 16 of body 11. Thus, the wall 21 of material-treating container 20 will extend coextensively in its entirety relative to wall 16 of body 11, thereby providing extensive contact therebetween to insure hermetic sealing. Also, the annular shoulder 23 will bear against edge 29 of container bottom portion 27. Preferably, the outer edge of rim 22 does not extend outwardly beyond the outer surface of wall 16 of body 11. Since the material-treating container 20 is installed into body 11 after the body 11 has been filled, the material-treating container 20 can be protected against exposure to the environment until it is actually installed.

While the sorbent container 20 can be used with any type of container or bottle, it is especially good for containers such as shown in FIG. 1 having a snap cap and a safety seal or to a container having a screw top and a safety seal because there is no need to apply the safety seal after the container has been filled with subject matter and a separate material-treating device, as this involves a time delay prior to the time that the container is closed, thereby exposing the material-treating device to an undesirable length of time, or requiring the filling and the sealing to be effected in a protected atmosphere where the material-treating device is not subject to exposure to the atmosphere.

Figure 4:
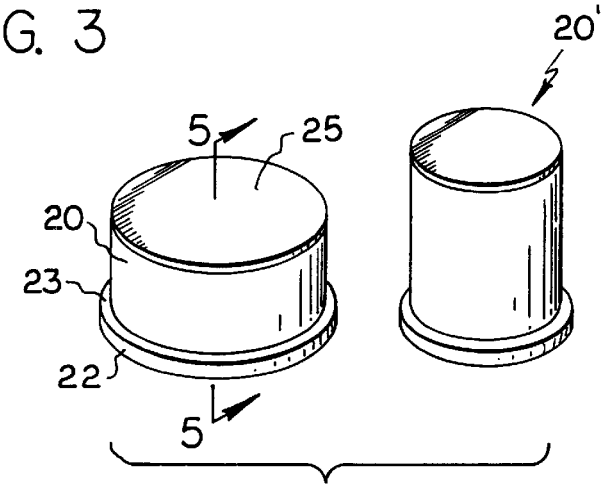
FIG. 4 is a perspective view showing different sizes of material-treating containers.
Figure 5:
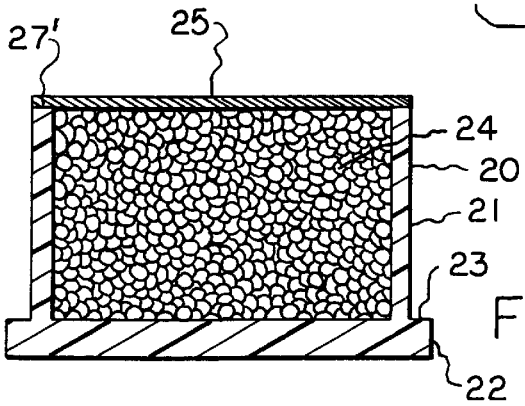
FIG. 5 is an enlarged cross sectional view taken substantially along line 5—5 of FIG. 4.

It will also be appreciated that the material-treating container can be fabricated in any diameter and length so that it can be inserted into different size containers and also can carry a desired amount of material-treating substance. A material-treating container 20' of a different shape but having all of the characteristics of material-treating container 20 is shown in FIG. 4.

While the connection between material-treating container 20 and container 11 has been described as a press-fit which provides a hermetic seal, it will be appreciated that, if desired, an adhesive can be placed between the wall of the container and the wall of the material-treating container, or at the joint between the shoulder 23 of rim 22 and the bottom edge 29 of container wall 16, or both, or suitable heat-sealing or electrical impulse sealing or welding techniques may be applied between the container 10 and the material-treating container 20. It will also be appreciated that the coextensive relationship between the walls 16 and 21 may be sufficiently close without providing a hermetic seal, and in this instance adhesive may be used, as described above, to provide both the desired hermetic sealing as well as a permanent connection.

While the above description has been directed to a container having a connected cover, it will be appreciated that the container can have a separate cover and that, if desired, the material-treating container can be installed into the container body before it is filled and the cover is applied.

While preferred embodiments of the present invention have been disclosed, it will be appreciated that it is not limited thereto but may be otherwise embodied within the scope of the following claims.

What is claimed is:

1. A container comprising a body, a top portion and an open bottom portion on said body, a first wall on said body, a material-treating container, a second wall on said material-treating container, a material-treating substance in said material-treating container, a permeable membrane on said material-treating container, and said material-treating container being inserted into said open bottom portion with said second wall being positioned coextensively with said first wall and with said material-treating container in hermetic sealing relationship with said body and with said permeable cover within said body.

2. A container as set forth in claim 1 wherein said first and second walls are cylindrical.

3. A container as set forth in claim 1 wherein said second wall engages said first wall substantially throughout its length.

4. A container as set forth in claim 3 wherein said first and second walls are cylindrical.

5. A container as set forth in claim 3 wherein said second wall is press-fitted into said first wall.

6. A container as set forth in claim 5 wherein said first and second walls are cylindrical.

7. A container as set forth in claim 1 wherein said second wall is press-fitted into said first wall.

8. A container as set forth in claim 1 wherein said material-treating substance is a desiccant.

9. A container as set forth in claim 1 wherein said material-treating substance is an oxygen absorber.

10. A container comprising a body, a top portion and a bottom portion on said body, a first wall on said body, a material-treating container, a second wall on said material-treating container, a material-treating substance in said material-treating container, a permeable membrane on said material-treating container, said second wall being positioned coextensively with said first wall and with said material-treating container in hermetic sealing relationship with said first wall and with said permeable cover within said body, said second wall engaging said first wall substantially throughout its length, an edge at said bottom portion of said body, a rim on said material-treating container, and a shoulder on said rim in engagement with said edge.

11. A container as set forth in claim 10 wherein said first and second walls are cylindrical.

12. A container comprising a body, a top portion and a bottom portion on said body, a first wall on said body, a material-treating container, a second wall on said material-treating container, a material-treating substance in said material-treating container, a permeable membrane on said material-treating container, said second wall being positioned coextensively with said first wall and with said material-treating container in hermetic sealing relationship with said first wall and with said permeable cover within said body, said second wall engaging said first wall substantially throughout its length, said second wall being press-fitted into said first wall, an edge at said bottom of said body, a rim on said material-treating container, and a shoulder on said rim in engagement with said edge.

13. A container as set forth in claim 12 wherein said first and second walls are cylindrical.

14. A container comprising a body, a top portion and a bottom portion on said body, a first wall on said body, a material-treating container, a second wall on said material-treating container, a material-treating substance in said material-treating container, a permeable membrane on said material-treating container, said second wall being positioned coextensively with said first wall and with said material-treating container in hermetic sealing relationship with said first wall and with said permeable cover within said body, an edge at said bottom-portion of said body, a rim on said material-treating container, and a shoulder on said rim in engagement with said edge.

15. A container comprising a body, a top portion and a bottom portion on said body, a first wall on said body, a material-treating container, a second wall on said material-treating container, a material-treating substance in said material-treating container, a permeable membrane on said material-treating container, said second wall being positioned coextensively with said first wall and with said material-treating container in hermetic sealing relationship with said first wall and with said permeable cover within said body, said second wall being press-fitted into said first wall, an edge at said bottom portion of said body, a rim on said material-treating container, and a shoulder on said rim in engagement with said edge.

16. A method of fabricating a container comprising the steps of providing a body having a first wall with an open bottom, providing a material-treating container with a material-treating substance therein and having a permeable membrane thereon and having a second wall, and installing said second wall through said open bottom into coextensive engagement with said first wall and with said permeable membrane within said body.

17. A container as set forth in claim 16 wherein said first and second walls are cylindrical.

18. A method as set forth in claim 16, including the step of filling said body through said open bottom prior to installing said second wall into said first wall.

19. A container as set forth in claim 18 wherein said second wall is press-fitted into said first wall.

20. A container as set forth in claim 19 wherein said first and second walls are cylindrical.

21. A container as set forth in claim 18 wherein said first and second walls are cylindrical.

22. A method of fabricating and filling a container comprising the steps of providing a body having a top portion and an open bottom portion and a cover secured to said top portion, inserting material into said body through said open bottom portion, providing a material-treating container with a material-treating substance therein having a permeable membrane thereon, and installing said material-treating container into said open bottom portion and with said permeable membrane within said body.

23. A method as set forth in claim 22 wherein said body has a first wall and wherein said material-treating container has a second wall, and wherein said second wall is press-fitted into said first wall.

* * * * *

UNITED STATES PATENT AND TRADEMARK OFFICE

CERTIFICATE OF CORRECTION

PATENT NO. : 6,571,942 B2 
DATED : June 3, 2003
INVENTOR(S) : Paul A. Riemenschneider and James V. Renda It is certified that error appears in the above-identified patent and that said Letters Patent is hereby corrected as shown below:

Column 5,
Line 3, after "bottom" and before the comma insert -- and a top portion and a cover secured to said top portion --.

Signed and Sealed this

Ninth Day of September, 2003

JAMES E. ROGAN
*Director of the United States Patent and Trademark Office*